US009881554B2

(12) United States Patent
Meng et al.

(10) Patent No.: US 9,881,554 B2
(45) Date of Patent: Jan. 30, 2018

(54) DRIVING METHOD OF PIXEL CIRCUIT AND DRIVING DEVICE THEREOF

(71) Applicant: BOE TECHNOLOGY GROUP CO., LTD., Beijing (CN)

(72) Inventors: Song Meng, Beijing (CN); Danna Song, Beijing (CN)

(73) Assignee: BOE TECHNOLOGY GROUP CO., LTD., Beijing. (CN)

( * ) Notice: Subject to any disclaimer, the term of this patent is extended or adjusted under 35 U.S.C. 154(b) by 17 days.

(21) Appl. No.: 14/907,448

(22) PCT Filed: Sep. 16, 2015

(86) PCT No.: PCT/CN2015/089719
§ 371 (c)(1),
(2) Date: Jan. 25, 2016

(87) PCT Pub. No.: WO2016/127639
PCT Pub. Date: Aug. 18, 2016

(65) Prior Publication Data

US 2016/0232848 A1 Aug. 11, 2016

(30) Foreign Application Priority Data

Feb. 11, 2015 (CN) ..... 2015 1 0073656

(51) Int. Cl.
*G09G 3/32* (2016.01)
*G09G 3/3258* (2016.01)
*G09G 3/20* (2006.01)

(52) U.S. Cl.
CPC ..... *G09G 3/3258* (2013.01); *G09G 3/2014* (2013.01); *G09G 2310/08* (2013.01); *G09G 2360/16* (2013.01)

(58) Field of Classification Search
CPC combination set(s) only.
See application file for complete search history.

(56) References Cited

U.S. PATENT DOCUMENTS 4,110,664 A * 8/1978 Asars ..... G01R 13/405 345/208
2003/0063078 A1 4/2003 Hanari et al.
(Continued)

FOREIGN PATENT DOCUMENTS

CN 1444076 A 9/2003
CN 1890703 A 1/2007
(Continued)

OTHER PUBLICATIONS

Chinese Office Action dated Jul. 15, 2016.
Search Report and Written Opinion dated Dec. 3, 2015 from State Intellectual Property Office of the P.R. China.

*Primary Examiner* — Van Chow
(74) *Attorney, Agent, or Firm* — Dilworth & Barrese, LLP.; Michael J. Musella, Esq

(57) ABSTRACT

Embodiments of the present disclosure relate to a technical field of display technology, and provide a driving method for a pixel circuit and a driving device thereof. A problem of cost increase can be solved which is caused by an increase in a number of storages when adjustment is made by way of Gamma curve and table lookup, by means of the technical solutions according to embodiments of the present disclosure. The driving method of the pixel circuit includes acquiring brightness information of a display screen in a light-emitting phase (S101); determining a duty cycle of a pulse signal according to the brightness information (S102); inputting a high level to the first voltage terminal, and inputting the pulse signal with the duty cycle to a gate of the first switching transistor by the first gate line (S103).

16 Claims, 4 Drawing Sheets

(56) References Cited

U.S. PATENT DOCUMENTS

| | | | | |
|---|---|---|---|---|
| 2005/0083269 | A1 | 4/2005 | Lin et al. | |
| 2010/0039454 | A1 | 2/2010 | Nakamura et al. | |
| 2013/0342435 | A1* | 12/2013 | Limketkai ..... | G09G 3/3655 345/107 |
| 2016/0180770 | A1* | 6/2016 | Duan ..... | G09G 3/3233 345/690 |

FOREIGN PATENT DOCUMENTS

| | | | |
|---|---|---|---|
| CN | 101147185 | A | 3/2008 |
| CN | 101908309 | A | 12/2010 |
| CN | 101958101 | A | 1/2011 |
| CN | 103440840 | A | 12/2013 |
| CN | 103943067 | A | 7/2014 |
| CN | 104599637 | A | 5/2015 |

* cited by examiner

DRIVING METHOD OF PIXEL CIRCUIT AND DRIVING DEVICE THEREOF

TECHNICAL FIELD

The present disclosure relates to a technical field of display technology, and particularly to a driving method of a pixel circuit and a driving device thereof.

BACKGROUND ART

With the rapid development of display technology, semiconductor component technology has made progress in leaps and bounds therewith as the core of a display device. As to existing display devices, the OLED (Organic Light Emitting Diode), as a current mode light-emitting device, is more and more applied in the field of high performance display, due to its characteristics of autoluminescence, quick response, wide angle of view, capability of being made on a flexible substrate, etc. According to the driving method, the OLED may be divided into two types: PMOLED (Passive Matrix Driving OLED) and AMOLED (Active Matrix Driving OLED). Since an AMOLED display possesses advantages of low manufacturing cost, high response rate, power saving, direct driving applicable to portable devices, large range of working temperature, etc., it is more and more applied in the field of high performance display.

However, in the process of using an AMOLED display for viewing a display image, a perception degree of human eyes may vary with a brightness of ambient light. For example, when the ambient light is relatively bright, it is necessary to turn up the brightness of the display so as to make the display image clearer; when the ambient light is relatively dark, it is necessary to turn down the brightness of the display to avoid the dazzling sense brought by the display image with higher brightness. Therefore, persons need to adjust the brightness of the display image according to different viewing environment.

In the prior art, a purpose of adjusting display brightness is achieved by adjusting the data voltage Vdata output by data line. In the process of adjusting a data voltage, firstly a grayscale value is converted to a brightness value by way of lookup table, according to Gamma curve (e.g., Gamma 2.2), and then gain computation of corresponding times is applied to the brightness value, thereby adjusting the brightness value. In order to display the brightness-adjusted image, it is further required to convert the adjusted brightness value to a grayscale value by way of lookup table according to the Gamma curve, and then the grayscale value is input to every pixel circuit through data line. In summary, the above method requires a number of lookup steps in the process of brightness adjustment, therefore it is required to add numerous storages. Accordingly, many FPGA (Field-Programmable Gate Array) resources are taken up, increasing a cost of production.

SUMMARY

Embodiments of the present disclosure provide a driving method of a pixel circuit and a driving device thereof, which is able to solve a problem of cost increase caused by increasing the number of storages when brightness is adjusted by way of Gamma curve and lookup table.

In order to achieve the above purpose, embodiments of the present disclosure adopt technical solutions as below.

In one aspect of embodiments of the present disclosure, a driving method of a pixel circuit is provided. The pixel circuit includes a driving transistor, a light-emitting device having an anode connected with a second electrode of the driving transistor, and a first switching transistor. The first switching transistor has a first electrode connected with a first voltage terminal, a second electrode connected with a first electrode of the driving transistor, and a gate connected with a first gate line. The driving method includes: in a light-emitting phase, acquiring a brightness information of a display image; determining a duty cycle of a pulse signal according to the brightness information; inputting a high level to the first voltage terminal, and inputting a pulse signal with the duty cycle to the gate of the first switching transistor by the first gate line, to control luminescence time of the light-emitting device.

In another aspect of embodiments of the present disclosure, a driving device of a pixel circuit is provided. The pixel circuit includes a driving transistor, a light-emitting device having an anode connected with a second electrode of the driving transistor, and a first switching transistor. The first switching transistor has a first electrode connected with a first voltage terminal, a second electrode connected with the first electrode of the driving transistor, and a gate connected with a first gate line. The driving device includes an acquiring unit, a duty cycle determining unit and a pulse signal triggering unit. The acquiring unit is used for acquiring brightness information of a display image in a light-emitting phase of the pixel circuit. The duty cycle determining unit is used for determining a duty cycle of a pulse signal according to the brightness information. The pulse signal triggering unit is used for inputting the pulse signal with the duty cycle to the gate of the first switching transistor through the first gate line when a high level is input to the first voltage terminal, to control luminescence time of the light-emitting device.

When the driving transistor is turned on, the high level input at the first voltage terminal can make a driving current flowing through the driving transistor drive a light-emitting device to emit light, and the pulse signal with the duty cycle can control the ON and OFF of the light-emitting device, thereby controlling luminescence time of the light-emitting device and changing a effective value of the driving current of the light-emitting device. Accordingly, in the driving process of the pixel circuit, the purpose of adjusting the brightness of the light-emitting device may be realized. Thus, in one aspect, since in the above process of adjusting the brightness of the light-emitting device, a table lookup step of the interchange process between brightness and grayscale is not involved, the number of storages and the occupancy rate of FPGA resources may be reduced, thereby achieving a purpose of lowering the cost; in another aspect, in the process of adjusting the brightness, there is no change in grayscale value of data line input, so an impact on a fineness of the display image is avoided which is caused by a reduction in adjustable range of grayscale in the process of adjusting the brightness.

BRIEF DESCRIPTION OF THE DRAWINGS

In order to more clearly illustrate the technical solutions of embodiments of the present disclosure or the prior art, drawings necessary for the description of embodiments or the prior art are briefly introduced below. Obviously, the drawings described below are merely some embodiments of the present disclosure, a person of ordinary skill in the art can also obtain other drawings according to these drawings.

DETAILED DESCRIPTION

The technical solutions of embodiments of the present disclosure will be described clearly and completely below in combination with the drawings in the embodiments of the present disclosure. Obviously, the described embodiments are merely part of embodiments of the present disclosure, but not all embodiments. All the other embodiments that a person of ordinary skill in the art may obtain based on embodiments of the present disclosure, belong to the protection scope of the present disclosure.

Figure 1:
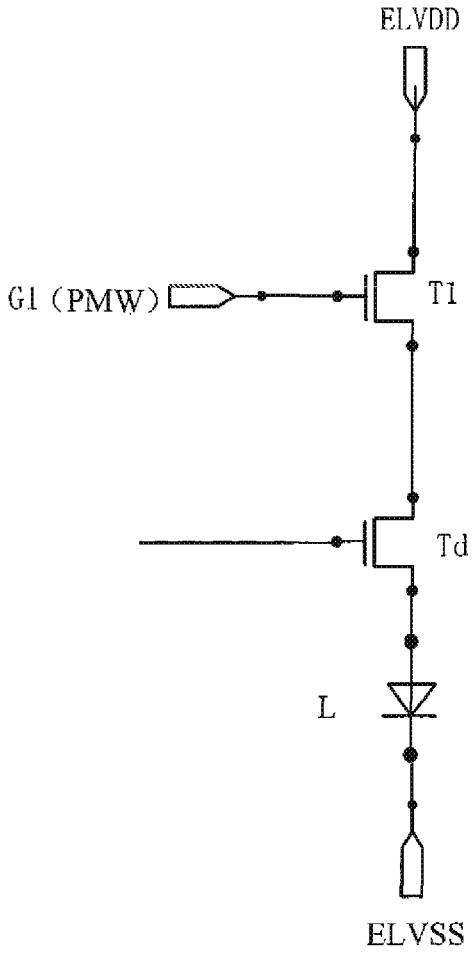
FIG. 1 is a schematic structural diagram of a pixel circuit provided by an embodiment of the present disclosure.
Figure 2:
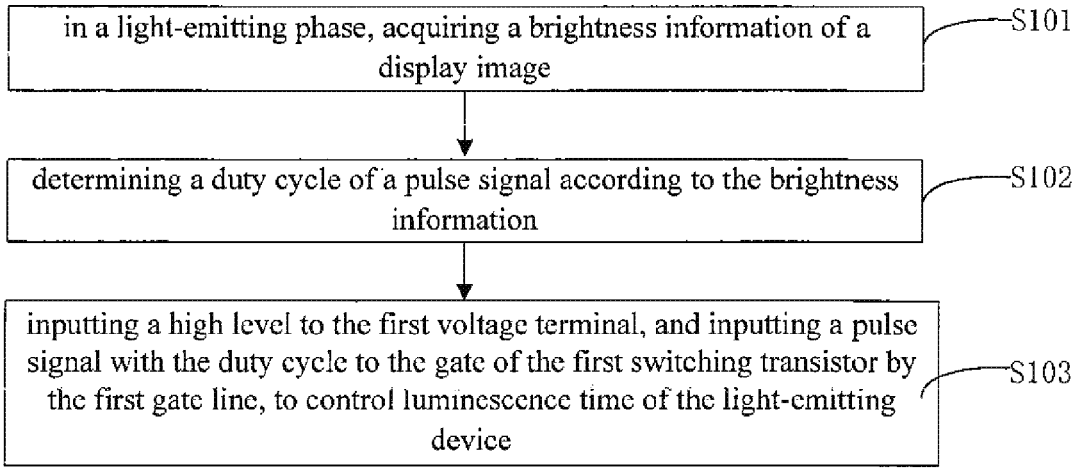
FIG. 2 is a flow chart of a driving method for the pixel circuit provided by an embodiment of the present disclosure.
Figure 5:
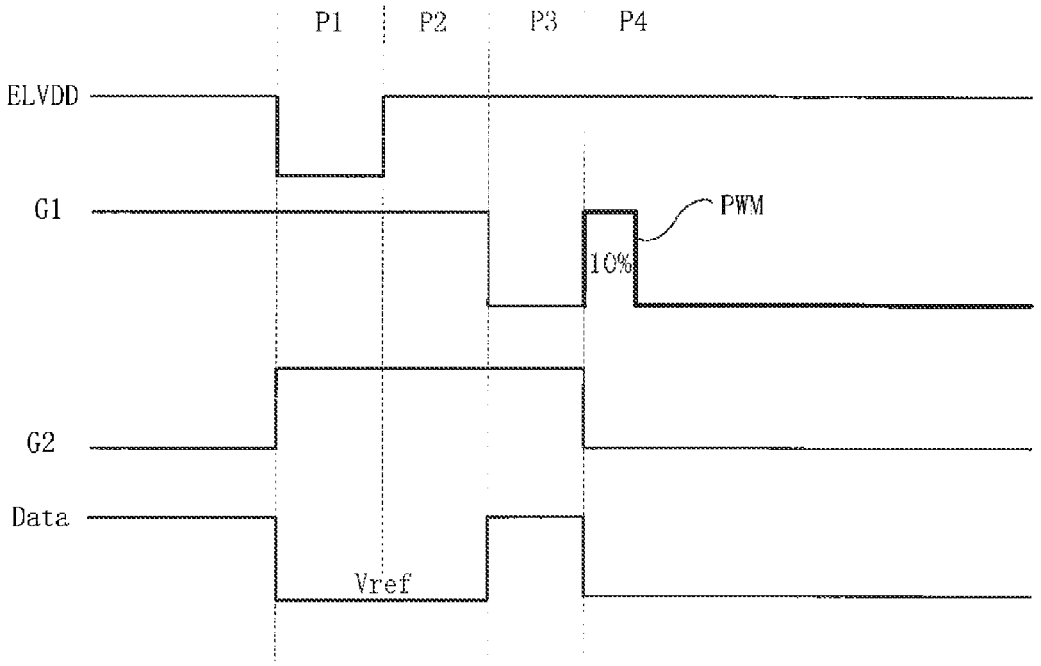
FIG. 5 is a timing diagram of a control signal provided by an embodiment of the present disclosure.

Embodiments of the present disclosure provide a driving method of a pixel circuit. As shown in FIG. 1, the pixel circuit may include a driving transistor Td, a light-emitting device L having an anode connected with a second electrode of the driving transistor Td, and a first switching transistor T1. The first switching transistor T1 has a first electrode connected with a first voltage terminal ELVDD, a second electrode connected with a first electrode of the driving transistor Td, and a gate connected with a first gate line G1. As shown in FIG. 2, the above driving method may include S101 to S103. In S101, brightness information of a display image is obtained in a light-emitting phase P4 as shown in FIG. 5. In S102, the duty cycle of a pulse signal is determined according to the brightness information. In S103, a high level is input to the first voltage terminal ELVDD, and the first gate line G1 inputs a pulse signal PWM (Pulse Width Modulation) with a duty cycle to the gate of the first switching transistor T1, to control luminescence time of the light-emitting device L.

It should be noted that a cathode of the light-emitting device L is connected with a second voltage terminal ELVSS. Wherein, the light-emitting device L may be various current-driving light-emitting devices in the prior art, including LED (Light Emitting Diode) or OLED (Organic Light Emitting Diode). In embodiments of the present disclosure, the OLED is taken as an example for illustration.

Embodiments of the present disclosure provide a driving method of a pixel circuit. The pixel circuit includes a driving transistor, a light-emitting device having an anode connected with a second electrode of the driving transistor, and a first switching transistor. The first switching transistor has a first electrode connected with a first voltage terminal, a second electrode connected with a first electrode of the driving transistor, and a gate connected with a first gate line. The driving method of the pixel circuit includes that: firstly, brightness information of a display image is obtained in the light-emitting phase; then, a duty cycle of a pulse signal is determined according to the brightness information, thereby making the duty cycle of the pulse signal match with the above brightness information; lastly, a high level is input to the first voltage terminal, and the first gate line inputs the pulse signal with the duty cycle to the gate of the first switching transistor. When the driving transistor is turned on, the high level input at the first voltage terminal can make a driving current flowing through the driving transistor drive a light-emitting device for light, and the pulse signal with the duty cycle can control ON and OFF of the light-emitting device, thereby controlling luminescence time of the light-emitting device and changing a effective value of driving current of the light-emitting device. Accordingly, in the driving process of the pixel circuit, a purpose of adjusting the brightness of the light-emitting device may be realized.

Thus, in one aspect, since a table lookup step of a interchange process between brightness and grayscale is not involved in the above process of adjusting the brightness of the light-emitting device, the number of storages and the occupancy rate of FPGA resources may be reduced, thereby achieving a purpose of lowering the cost. In another aspect, in the process of adjusting the brightness, there is no change in grayscale value of data line input, so an impact on a fineness of the display image is avoided which caused by the reduction in the adjustable range of grayscale in the process of adjusting the brightness.

Particularly, in the prior art, in a process of adjusting brightness of a full screen, it is firstly required to convert a grayscale value of a single pixel unit to a brightness value, and then convert the adjusted brightness value to a corresponding grayscale value after making calculation for the brightness value, thereby achieving a purpose of changing the display brightness by changing a grayscale of the pixel unit. Therefore, a process of adjusting the full screen brightness in the prior art is virtually to adjust maximum in a adjustable range of grayscale.

For example, when maximum 255 of an adjustable range of grayscale 0~255 is reduced to maximum 60 of an adjustable range of grayscale 0~60, since the maximum of the adjustable range of the full screen brightness grayscale is reduced, an entire brightness of the full screen is lowered. In this case, the grayscale value of the screen can only vary within 0~60 for a single pixel unit. Therefore, in the same pixel unit, two frames with close grayscale may not be recognized by human eyes, thereby making the display screen not fine enough. In the driving method provided by embodiments of the present disclosure, there is no change in the grayscale value of data line input while adjusting the brightness. Therefore, the adjustable range of grayscale is still 0~255, without affecting the fineness of the display screen.

Examples are given below for the above brightness information of the display screen.

Embodiment I

The above brightness information may include a brightness value of the display screen. That is, the brightness information may be a specific value representing the brightness, for example, the brightness information may be X cd/m$^2$ (candela per square meter). Thus, a duty cycle of a pulse signal corresponding to a brightness value of X cd/m$^2$ (candela per square meter) may be found out from a table storing a correspondence between the brightness value of the display screen and the duty cycle of the pulse signal. Next, ON and OFF of a light-emitting diode OLED is controlled by the pulse signal PWM with the duty cycle, to control luminescence time of the light-emitting diode OLED, thereby changing an effective value of a driving current flowing through the light-emitting diode OLED during the light-emitting phase P4. When the driving current has a relatively large effective value, the light-emitting diode OLED has a higher brightness; when the driving current has a relatively small effective value, the light-emitting diode OLED has a lower brightness. Thus, the effective brightness value of the light-emitting diode OLED is made the same as a target brightness value of X cd/m$^2$ by controlling the effective value of the driving current of the light-emitting diode OLED, thereby realizing the adjustment of the brightness of the light-emitting diode OLED.

Furthermore, although the above adjusting process is illustrated with the example of one pixel unit, it is equally suitable for adjusting a full screen brightness of a display panel. Particularly, a display panel may include a plurality of pixel units arranged in form of matrix, and pixel units in the same row may be controlled by the same gate line. The above pulse signal PWM may be input to a first switching transistor T1 through a gate line G1. The gate line G1 of each row controls a row of pixel units, and the above first switching transistor T1 is set in the pixel circuit of each pixel unit. Therefore, in a process of progressively scanning respective gate lines in the display panel by a gate driving circuit, the pulse signal PWM is input row by row to all first gate lines G1 in the display panel. Accordingly, a adjustment of full screen brightness of the display panel may be realized.

Figure 3A:
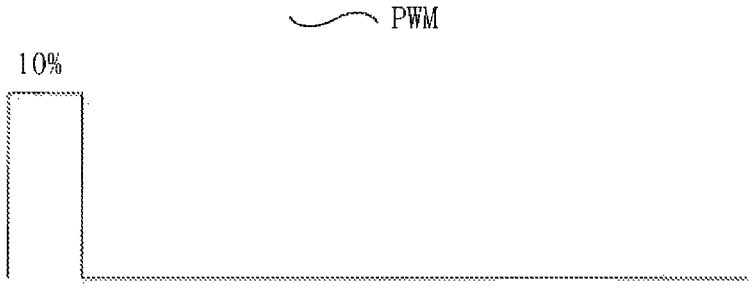
FIG. 3*a* is a pulse signal provided by an embodiment of the present disclosure.
Figure 3B:
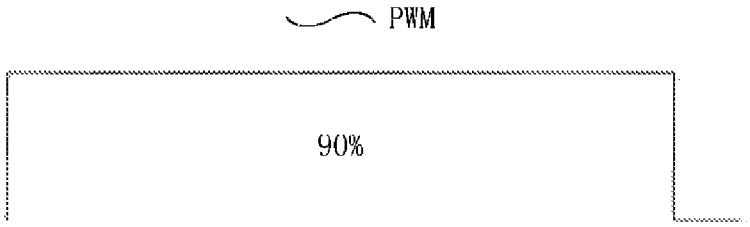
FIG. 3*b* is another pulse signal provided by an embodiment of the present disclosure.

It should be noted that for a single pixel unit, in a case that there is no change in a data voltage Vdata input to the pixel unit through data line, the pulse signal PWM can control a magnitude of the effective value of the driving current flowing through the light-emitting diode OLED. Particularly, when the pulse signal PWM has a duty cycle of 10% as shown in FIG. 3*a*, in the entire light-emitting phase P4, there is a driving current flowing through the light-emitting diode OLED only within 10% of the time, thereby the effective value of the driving current may be made as 10% of the driving current of the light-emitting diode OLED when it keeps luminescent during the light-emitting phase. When the pulse signal PWM has a duty cycle of 90% as shown in FIG. 3*b*, in the entire light-emitting phase P4, there is a driving current flowing through the light-emitting diode OLED within 90% of the time, thereby the effective value of the driving current may be made as about 90% of the driving current of the light-emitting diode OLED when it keeps luminescent during the light-emitting phase.

Embodiment II

The above brightness information may include a display mode corresponding to a brightness value of a display image, for example, the brightness information may be night mode, outdoor mode, rainy day mode, etc. Commonly, since a brightness of environment light at night is lower than that of rainy days, and the brightness of environment light in rainy days is lower than that of fine days outdoors. Therefore, there might be a dazzling phenomenon at night and in rainy days which is caused by an overhigh brightness value of a display image; and there might be a phenomenon of unclear screen in fine days outdoors which is caused by a fact that a brightness value of a display screen is too low and environment light is relatively strong. In order to avoid the phenomena, a brightness value of a display screen corresponding to a night mode may be adjusted to be less than that corresponding to a rainy day mode, and a brightness value corresponding to a rainy day mode may be adjusted to be less than that corresponding to an outdoor mode.

Thus, a duty cycle of a pulse signal corresponding to a display mode may be looked for from a table storing a correspondence between the display mode and the duty cycle of the pulse signal. Next, a luminescence time of a light-emitting diode OLED is controlled by the pulse signal PWM with the duty cycle, thereby changing the effective value of the driving current flowing through the light-emitting diode OLED during the light-emitting phase P4, and making the effective brightness value of the light-emitting diode OLED the same as a target brightness value of X cd/m$^2$, thereby the adjustment of the brightness of the light-emitting diode OLED is realized.

Embodiment III

In a case that the brightness value is a percentage value, the determining the duty cycle of a pulse signal according to the brightness information may include that the percentage value of a brightness value may be equal to that of a duty cycle.

For example, for a single pixel unit, in a case that there is no change in the data voltage Vdata input to the pixel unit through data line, if a light-emitting diode OLED has a brightness threshold T when it keeps luminescent during the light-emitting phase, when a brightness value is 10% of the brightness threshold T, the pulse signal PWM may have a duty cycle of 10% as shown in FIG. 3*a*. Or, when a brightness value is 90% of the brightness threshold T, the pulse signal PWM may have a duty cycle of 90% as shown in FIG. 3*b*. Thus, the duty cycle of the pulse signal PWM may be obtained intuitively according to the brightness value.

In summary, if a display screen has a full screen brightness threshold of U when light-emitting diodes OLED of all the pixel units keep luminescent during the light-emitting phase, then the full screen brightness of the display screen may be 10% of the full screen brightness threshold U when the brightness value of each pixel unit among all the pixel units is 10% of the brightness threshold T. In the same way, when the brightness value of each pixel unit among all the pixel units is 90% of the brightness threshold T, the full screen brightness of the display screen may be 90% of the full screen brightness threshold U. In the above embodiment, it is illustrated merely with an example of the duty cycle of the pulse signal PWM as 10% or 90%. The pulse signal PWM with other duty cycles will not be described any more, which however should all belong to the protection scope of the present disclosure.

When the pulse signal PWM has a duty cycle within a range of 10%~90%, the duty cycle of the pulse signal PWM which will be input for two adjacent display images has a minimum step value of 10%, for example, a first pulse signal PWM has a duty cycle of 10%, and a second pulse signal PWM has a duty cycle of 20% after a minimum step value is added. In the process of adjusting the brightness of the display screen, the minimum brightness step value of two adjacent display images is 10% of the brightness threshold T. Therefore, if the minimum brightness step value is too large, then in the process of adjusting the brightness, the brightness difference between two adjacent display images will be relatively large.

In order to solve the above problem, the minimum step value of the duty cycle of the pulse signal PWM which will be input for two adjacent display images may be reduced, for example, when the minimum step value of the duty cycle of the pulse signal PWM required to be input for two adjacent display images is 10‰, the minimum brightness step value of two adjacent display images may be 10‰ of the brightness threshold T. Thus, the minimum brightness step value may be reduced and the brightness difference between two adjacent display images may be lowered, improving the display effect.

There set a plurality of TFTs (Thin Film Transistor) on the array substrate of an OLED display. In order to increase a carrier mobility of the TFT and reduce a resistivity to have low power consumption with the same current passed through, polysilicon is generally adopted to constitute the above TFT. However, because of production techniques and characteristics of polysilicon, when a TFT switching circuit is fabricated on a large area of glass substrate, the electrical parameters such as threshold voltage Vth, mobility, etc. often fluctuate, thereby making the current flowing through the OLED device not only vary with a ON voltage stress produced by long time of ON of the TFT, but also vary with a drift of the threshold voltage Vth of the TFT. Thus, a brightness uniformity and a brightness constancy of the display will be influenced, thereby reducing the image character and quality of the display.

In order to solve the above problem, an OLED pixel circuit with compensation function may be set in the display. A method for implementing the above brightness in the process of driving the OLED pixel circuit will be described in detail below with a particular embodiment, taking the OLED pixel circuit with compensation function as shown in FIG. 4 as an example.

Embodiment IV

Figure 4:
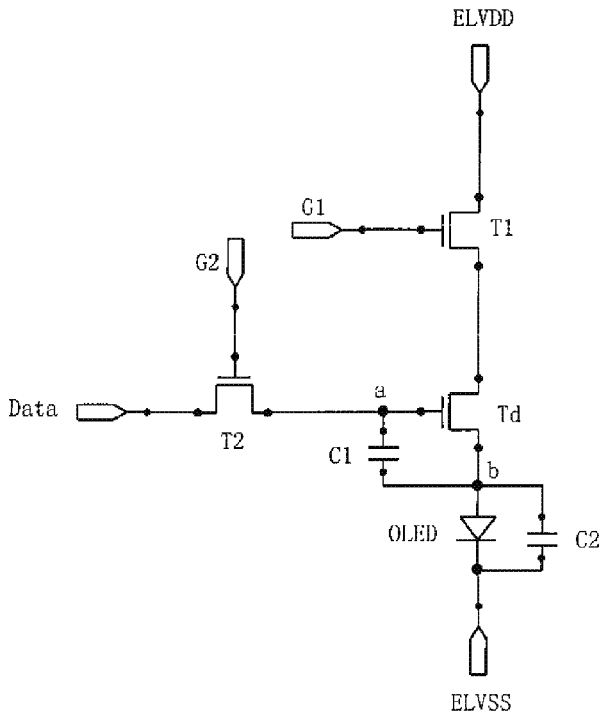
FIG. 4 is a schematic structural diagram of another pixel circuit provided by an embodiment of the present disclosure.

As shown in FIG. 4, the above pixel circuit may further include a second switching transistor T2, a first capacitor C1 and a second capacitor C2.

The second switching transistor T2 has a first electrode connected with a data line Data, a second electrode connected with the gate of the driving transistor Td, and a gate connected with a second gate line G2.

The first capacitor C1 has one terminal connected with the gate of the driving transistor Td, and another terminal connected with the light-emitting device, such as the anode of the light-emitting diode OLED.

The second capacitor C2 has one terminal connected with the light-emitting device, such as the anode of the light-emitting diode OLED, and another terminal connected with the second voltage terminal ELVSS.

It should be noted that, firstly, all the transistors (Td, T1 and T2) in the present disclosure may be depletion mode transistor, or may be enhancement mode transistor. The present disclosure has no limitation on it, but they all belong to the protection scope of the present disclosure. Secondly, a low level is input to the second voltage terminal ELVSS, or the second voltage terminal ELVSS is grounded. Thirdly, all the transistors (Td, T1 and T2) in the present disclosure may be N type transistors, or may be P type transistors. The present disclosure has no limitation on it, but they all belong to the protection scope of the present disclosure.

The following embodiments are illustrated with the example that the driving transistor Td, the first switching transistor T1 and the second switching transistor T2 are all N type enhancement mode transistors.

On this basis, for an N type transistor, a source potential is lower than a drain potential, thus the carriers (electrons) in the N type transistor can flow from the source of the transistor with lower potential to the drain with higher potential after the transistor is turned on. Taking the driving transistor Td in FIG. 4 as an example, since the voltage input to the first voltage terminal ELVDD is used to drive the light-emitting diode OLED to emit light, the input voltage is normally larger than a voltage at the node b. Therefore, the second electrode of the driving transistor Td is the source, and the first electrode is the drain.

In summary, when the above transistors are all N type transistors, the first electrodes of the above transistors may all be drains, and the second electrodes may all be sources.

The working process of the pixel circuit as shown in FIG. 4 is illustrated in detail below, in combination with control signal timing as shown in FIG. 5.

As shown in FIG. 5, the working process of the pixel circuit may be divided into four phases: reset phase, compensation phase, writing phase, and light-emitting phase, represented by P1, P2, P3, and P4 respectively.

In the reset phase P1, a low level is input to the first voltage terminal ELVDD, a high level is input to the first gate line G1, a high level is input to the second gate line G2, and a reference voltage Vref is input to the data line Data. In embodiments of the present disclosure, it is taken as an example for illustration that the reference voltage Vref is a low level.

In a case that a high level is input to the first gate line G1 and the second gate line G2, the first switching transistor T1 and the second switching transistor T2 may be respectively turned on, so that the reference voltage Vref input to the data line Data can be transmitted to the gate of the driving transistor Td and a node a has a potential of Vref, thus the gate voltage of the driving transistor Td and a voltages across the first capacitor C1 and a voltage across the second capacitor C2 are reset, thereby releasing the voltages at the gate of the driving transistor Td, the voltages across the first capacitor C1 and the voltages across the second capacitor C2 left in the process of the display of last frame. Therefore, the impact on the display of the present frame are avoided which are caused by residual voltages at the gate of the driving transistor Td, and across the first capacitor C1 and the second capacitor C2. In this phase, since the driving transistor Td is turned off, the light-emitting diode OLED does not emit light.

In the compensation phase P2, a high level is input to the first voltage terminal ELVDD, a high level is input to the first gate line G1, a high level is input to the second gate line, and the reference voltage Vref is input to the data line Data.

The first switching transistor T1 and the second switching transistor T2 continue to maintain ON state, a high level is input to the first voltage terminal ELVDD, the driving transistor Td in ON state is charged, and a level, which is lower than the potential at the gate (node a) of the driving transistor Td by one threshold voltage Vth of the driving transistor Td itself, is input to the source (node b) of the driving transistor Td, so that the node b has a potential of Vref−Vth. At this moment, the driving transistor Td is turned off, and the voltage across the first capacitor C1 is Vth.

In the writing phase P3, a high level is input to the first voltage terminal ELVDD, a low level is input to the first gate line G1, a high level is input to the second gate line G2, and the data voltage Vdata is input to the data line Data.

In the writing phase P3, the first switching transistor T1 is in OFF state, and the second switching transistor T2 and the driving transistor Td are turned on. The data voltage Vdata is input to the data line Data. Accordingly, under a function of voltage division of the first capacitor C1 and the second capacitor C2, the potential at the node b is Vref−Vth+a (Vdata−Vref), wherein, $a=C_{01}/(C_{01}+C_{02})$, $C_{01}$ is a capacitance value of the first capacitor C1, and $C_{02}$ is a capacitance value of the second capacitor C2. Furthermore, since the data voltage Vdata is input to the data line Data, the potential at the gate (node a) of the driving transistor Td is Vdata.

In the light-emitting phase P4, a high level is input to the first voltage terminal ELVDD, a low level is input to the second gate line G2, and a pulse signal PWM with the duty cycle (e.g. 10%) is input to the first gate line G1.

In the light-emitting phase P4, the second switching transistor T2 is in OFF state, and a pulse signal PWM with the duty cycle (e.g. 10%) is input to the first gate line G1, which is able to control the turn-on time of the first switching transistor T1, so that the first switching transistor T1 is in ON state within a time of 10% of the light-emitting phase P4, thereby controlling luminescence time of the OLED and changing the effective value of the driving current of the light-emitting diode OLED.

The luminescence brightness of the light-emitting diode OLED is related with the effective value of the driving current. The larger the effective value of the driving current, the higher the luminescence brightness of the light-emitting diode OLED; the smaller the effective value of the driving current, the lower the luminescence brightness of the light-emitting diode OLED. Since the pulse signal PWM is input by the first gate line G1, the pulse signal PWM may be input row by row to all first gate lines G1*s* in the display panel in the process of performing the progressive scanning for every gate line in the display panel by a gate driving circuit, thereby realizing a adjustment of the full screen brightness of the display panel.

Furthermore, in the above light-emitting phase P4, a high level is input to the first voltage terminal ELVDD, when the light-emitting diode OLED emits light under the control of the pulse signal PWM, the gate-source voltage of the driving transistor Td may be:

$$\begin{aligned} Vgs &= Va - Vb \\ &= (Vdata) - (Vref - Vth + a\ (Vdata - Vref)) \\ &= (1 - a) \times (Vdata - Vref) + Vth \end{aligned}$$

Accordingly, the current driving the OLED to emit light is:

$$I=K/2(Vgs-V\mathrm{th})^2=I=K/2((1-a)\times(V\mathrm{data}-V\mathrm{ref}));$$

wherein, K is a current constant associated with the driving transistor Td.

In summary, the current I for driving OLED for light has nothing to do with the threshold voltage Vth of the driving transistor Td, thereby avoiding a brightness difference of the display caused by the drift of the threshold voltage.

It should be noted that, in the above embodiment, it is taken as example for illustration that transistors are all N type enhancement mode TFTs. Or, N type depletion mode TFTs may also be adopted. What is different is that for the N type enhancement mode TFT, the threshold voltage Vth is positive, but for the N type depletion mode TFT, the threshold voltage Vth is negative.

Furthermore, when the above transistors are all P type transistors, corresponding adjustment is necessary for the timing of the driving signal, the input signal of the circuit and the connection direction of the light-emitting device L.

Particularly, the connection position of the first voltage terminal ELVDD is exchanged with that of the second voltage terminal. ELVSS in FIG. 4. For example, the first electrode of the first switching transistor T1, which was originally connected with the first voltage terminal ELVDD, is connected to the second voltage terminal ELVSS; and the cathode of the light-emitting device L, which was originally connected with the second voltage terminal ELVSS, is connected to the first voltage terminal ELVDD.

Moreover, it is also required to flip the directions of the signals output by the first gate line G1 and the second gate line G2. Furthermore, it is also required to exchange the directions of the cathode and the anode of the light-emitting device L in FIG. 4. The specific working process may be obtained in the same way, which will not be described any more but should all belong to the protection scope of the present disclosure.

Figure 6:
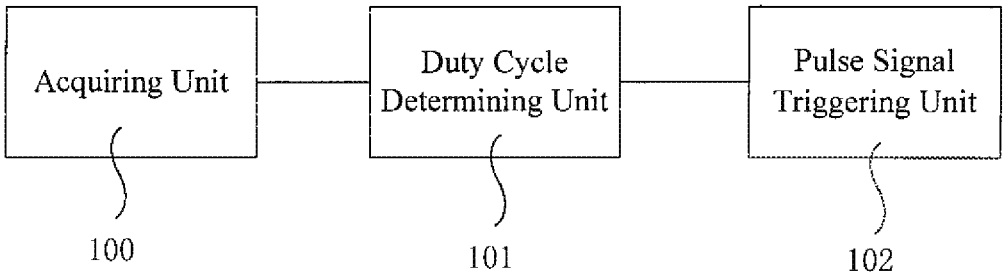
FIG. 6 is a schematic structural diagram of a driving device for the pixel circuit provided by an embodiment of the present disclosure.

Embodiments of the present disclosure provide a driving device of a pixel circuit. The pixel circuit, as shown in FIG. 1, may include a driving transistor Td, a light-emitting device L with its anode connected with a second electrode of the driving transistor Td, and a first switching transistor T1. The first switching transistor T1 has a first electrode connected with a first voltage terminal ELVDD, a second electrode connected with a first electrode of the driving transistor Td, and a gate connected with a first gate line G1. As shown in FIG. 6, the driving device may include: an acquiring unit 100, a duty cycle determining unit 101 and a pulse signal triggering unit 102.

Particularly, the acquiring unit 100 is used for acquiring brightness information of a display screen in the light-emitting phase P4 of the pixel circuit.

The duty cycle determining unit 101 is used for determining the duty cycle of a pulse signal according to the brightness information.

The pulse signal triggering unit 102 is used for inputting the pulse signal with the duty cycle to the gate of the first switching transistor T1 through the first gate line G1 when a high level is input to the first voltage terminal ELVDD, to control luminescence time of the light-emitting device L.

It should be noted that the above brightness information may include a brightness information of a display image, or the above brightness information may include a display mode corresponding to the brightness value of a display screen, for example, the brightness information may be night mode, outdoor mode, rainy day mode, etc. In the case that the brightness value is a percentage value, the percentage value of the brightness value may be equal to that of the duty cycle.

Embodiments of the present disclosure provide a driving device of a pixel circuit. The pixel circuit includes a driving transistor, a light-emitting device with its anode connected with the second electrode of the driving transistor, and a first switching transistor. The first switching transistor has a first electrode connected with a first voltage terminal, a second electrode connected with the first electrode of the driving transistor, and a gate connected with a first gate line. The driving device may include: an acquiring unit, a duty cycle determining unit and a pulse signal triggering unit. The acquiring unit is used for acquiring brightness information of the display screen in the light-emitting phase of the pixel circuit; the duty cycle determining unit is used for determining a duty cycle of a pulse signal according to the brightness information; the pulse signal triggering unit is used for inputting the pulse signal with the duty cycle to the first electrode of the driving transistor. When the driving transistor is turned on, the high level input at the first voltage terminal can make a driving current flowing through the driving transistor drive a light-emitting device to emit light, and the pulse signal with the duty cycle can control the ON and OFF of the light-emitting device, thereby controlling luminescence time of the light-emitting device and changing a effective value of the driving current of the light-emitting device. Further, in the driving process of the pixel circuit, a purpose of adjusting the brightness of the light-emitting device may be realized. Thus, in one aspect, since in the above process of adjusting the brightness of the light-emitting device, a table lookup step in a interchange process between brightness and grayscale is not involved, a number of storages and the occupancy rate of FPGA resources may be reduced, thereby achieving a purpose of lowering the cost; in another aspect, in the process of adjusting the brightness, there is no change in grayscale value of data line input, thus the impact on the fineness of a display screen is avoided which is caused by the reduction in adjustable range of grayscale in the process of adjusting the brightness.

Those of ordinary skill in the art may understand: all or part of the steps of the above method embodiments may be implemented by program instruction relevant hardware, which may be stored in a storage medium readable by a computer, and steps of embodiments including the above method are performed when the program is executed; and the storage medium may include various media able to store the program code, such as ROM, RAM, diskette, or CD, etc.

What is described above is only specific embodiments of the present disclosure, but the protection scope of the present disclosure is not limited thereto. Any person skilled in the art may readily think of variations or alternatives within the technology scope of the present disclosure, which should all be contained in the protection scope of the present disclosure. Therefore, the protection scope of the present disclosure should be in accordance with the claimed protection scope.

The application claims priority to China Patent Application No. 201510073656.0 filed on Feb. 11, 2015, which is incorporated herein by reference in its entirety.

The invention claimed is:

1. A driving method for a pixel circuit, the pixel circuit including a driving transistor, a light-emitting device having an anode connected with a second electrode of the driving transistor, and a first switching transistor, the first switching transistor having a first electrode connected with a first voltage terminal, a second electrode connected with a first electrode of the driving transistor, and a gate connected with a first gate line, wherein, the driving method comprises:

in a light-emitting phase, acquiring a brightness information of a display image;

determining a duty cycle of a pulse signal corresponding to the brightness information from a table storing a correspondence between the brightness information of the display image and the duty cycle of the pulse signal;

inputting a high level to the first voltage terminal, and inputting a pulse signal with the duty cycle to the gate of the first switching transistor by the first gate line, to control luminescence time of the light-emitting device.

2. The driving method for the pixel circuit of claim 1, wherein the brightness information includes a brightness value of the display image.

3. The driving method for the pixel circuit of claim 1, wherein the brightness information includes a display mode corresponding to a brightness value of the display screen.

4. The driving method for the pixel circuit of claim 2, wherein in a case that the brightness value is a percentage value, the determining a duty cycle of a pulse signal according to the brightness value includes:

a percentage value of the brightness value being equal to that of the duty cycle.

5. The driving method for the pixel circuit of claim 4, wherein the pixel circuit further includes a second switching transistor, a first capacitor and a second capacitor, the second switching transistor has a first electrode connected with a data line, a second electrode connected with a gate of the driving transistor, and a gate connected with a second gate line;

the first capacitor has one terminal connected with the gate of the driving transistor, and another terminal connected with the anode of the light-emitting device;

the second capacitor has one terminal connected with the anode of the light-emitting device, and another terminal connected with the second voltage terminal.

6. The driving method for the pixel circuit of claim 5, wherein the driving transistor, the first switching transistor and the second switching transistor are all N type transistors; or, the driving transistor, the first switching transistor and the second switching transistor are all P type transistors.

7. The driving method for the pixel circuit of claim 6, wherein the driving transistor, the first switching transistor and the second switching transistor are all enhancement mode transistors or depletion mode transistors.

8. The driving method for the pixel circuit of claim 7, wherein, in a case that both the first switching transistor and the second switching transistor are N type enhancement mode transistors, the first electrode of the driving transistor, the first electrode of the first switching transistor and the first electrode of the second switching transistor are drains, and their second electrodes are sources.

9. The driving method for the pixel circuit of claim 8, wherein the driving method includes:

in a reset phase, inputting a low level to the first voltage terminal, inputting a high level to the first gate line, the first switching transistor being turned on, inputting a high level to the second gate line, the second switching transistor being turned on, and inputting a reference voltage to the data line;

in a compensation phase, inputting a high level to the first gate line, the first switching transistor being turned on, inputting a high level to the second gate line, the second switching transistor being turned on, inputting a reference voltage to the data line, inputting a high level to the first voltage terminal, storing a threshold voltage of the driving transistor in the first capacitor;

in a writing phase, inputting a high level to the second gate line, the second switching transistor being turned on, a low level being input to the first gate line, the second switching transistor being in OFF state, writing the data voltage input to the data line into the gate of the driving transistor;

in a light-emitting phase, inputting a high level to the first voltage terminal, inputting a low level to the second gate line, the second switching transistor being turned off, and inputting a pulse signal with the duty cycle to the first gate line.

10. The driving method for the pixel circuit of claim 3, wherein in a case that the brightness value is a percentage value, the determining a duty cycle of a pulse signal according to the brightness value includes:

a percentage value of the brightness value being equal to that of the duty cycle.

11. The driving method for the pixel circuit of claim 10, wherein the pixel circuit further includes a second switching transistor, a first capacitor and a second capacitor, the second switching transistor has a first electrode connected with a data line, a second electrode connected with a gate of the driving transistor, and a gate connected with a second gate line;

the first capacitor has one terminal connected with the gate of the driving transistor, and another terminal connected with the anode of the light-emitting device;

the second capacitor has one terminal connected with the anode of the light-emitting device, and another terminal connected with the second voltage terminal.

12. The driving method for the pixel circuit of claim 11, wherein the driving transistor, the first switching transistor and the second switching transistor are all N type transistors; or, the driving transistor, the first switching transistor and the second switching transistor are all P type transistors.

13. The driving method for the pixel circuit of claim 12, wherein the driving transistor, the first switching transistor and the second switching transistor are all enhancement mode transistors or depletion mode transistors.

14. The driving method for the pixel circuit of claim 13, wherein, in a case that both the first switching transistor and the second switching transistor are N type enhancement mode transistors, the first electrode of the driving transistor, the first electrode of the first switching transistor and the first electrode of the second switching transistor are drains, and their second electrodes are sources.

15. The driving method for the pixel circuit of claim 14, wherein the driving method includes:

in a reset phase, inputting a low level to the first voltage terminal, inputting a high level to the first gate line, the first switching transistor being turned on, inputting a high level to the second gate line, the second switching transistor being turned on, and inputting a reference voltage to the data line;

in a compensation phase, inputting a high level to the first gate line, the first switching transistor being turned on, inputting a high level to the second gate line, the second switching transistor being turned on, inputting a reference voltage to the data line, inputting a high level to the first voltage terminal, storing a threshold voltage of the driving transistor in the first capacitor;

in a writing phase, inputting a high level to the second gate line, the second switching transistor being turned on, a low level being input to the first gate line, the second switching transistor being in OFF state, writing the data voltage input to the data line into the gate of the driving transistor;

in a light-emitting phase, inputting a high level to the first voltage terminal, inputting a low level to the second gate line, the second switching transistor being turned off, and inputting a pulse signal with the duty cycle to the first gate line.

16. A driving device for a pixel circuit, the pixel circuit comprising a driving transistor, a light-emitting device having an anode connected with a second electrode of the driving transistor, and a first switching transistor, the first switching transistor having a first electrode connected with a first voltage terminal, a second electrode connected with a first electrode of the driving transistor, and a gate connected with a first gate line, wherein, the driving device comprises an acquiring unit, a duty cycle determining unit and a pulse signal triggering unit, the acquiring unit is used for acquiring brightness information of a display screen in a light-emitting phase of the pixel circuit;

the duty cycle determining unit is used for determining a duty cycle of a pulse signal according to the brightness information;

the pulse signal triggering unit is used for inputting the pulse signal with the duty cycle to the gate of the first switching transistor through the first gate line when a high level is input to the first voltage terminal, to control luminescence time of the light-emitting device.

* * * * *